US008250865B2

(12) United States Patent
Pearson

(10) Patent No.: US 8,250,865 B2
(45) Date of Patent: Aug. 28, 2012

(54) USING COMPRESSED INTAKE AIR TO CLEAN ENGINE EXHAUST GAS RECIRCULATION COOLER

(75) Inventor: Gavin James Robert Pearson, Birmingham, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 931 days.

(21) Appl. No.: 12/265,466

(22) Filed: Nov. 5, 2008

(65) Prior Publication Data

US 2010/0107631 A1 May 6, 2010

(51) Int. Cl.

| | |
|---|---|
| ***F02B 33/44*** | (2006.01) |
| ***F02B 29/04*** | (2006.01) |
| ***F02M 25/07*** | (2006.01) |
| ***F01P 7/14*** | (2006.01) |

(52) U.S. Cl. ..... 60/605.2; 60/599; 123/568.12; 123/41.08

(58) Field of Classification Search ..... 60/605.2, 60/599; 123/568.12, 568.18, 41.08; *F02M 25/07; F02B 29/04*

See application file for complete search history.

(56) References Cited

U.S. PATENT DOCUMENTS

| | | | | |
|---|---|---|---|---|
| 5,440,880 | A | 8/1995 | Ceynow et al. | 60/605.2 |
| 5,517,976 | A * | 5/1996 | Bachle et al. | 60/605.2 |
| 6,003,315 | A * | 12/1999 | Bailey | 60/605.2 |
| 6,038,860 | A * | 3/2000 | Bailey | 60/605.2 |
| 6,367,256 | B1 | 4/2002 | McKee | 60/605.2 |
| 6,427,436 | B1 * | 8/2002 | Allansson et al. | 60/605.2 |
| 7,011,080 | B2 | 3/2006 | Kennedy | 60/605.2 |
| 7,299,771 | B2 * | 11/2007 | Wei et al. | 123/568.12 |
| 8,061,138 | B2 * | 11/2011 | Pearson | 60/605.2 |
| 2005/0000497 | A1 | 1/2005 | Nakai et al. | 60/605.2 |
| 2006/0124116 | A1 | 6/2006 | Bui | 123/568.12 |
| 2009/0217660 | A1 * | 9/2009 | Ranini et al. | 60/605.2 |
| 2009/0249782 | A1 * | 10/2009 | Li et al. | 60/605.2 |
| 2009/0313992 | A1 * | 12/2009 | Pearson | 60/605.2 |

FOREIGN PATENT DOCUMENTS

| | | | |
|---|---|---|---|
| DE | 4007516 | | 9/1991 |
| FR | 2892155 | A1 * | 4/2007 |
| JP | 11062715 | | 3/1999 |
| KR | 2004050267 | A * | 6/2004 |
| WO | WO 2010114431 | A1 * | 10/2010 |

* cited by examiner

*Primary Examiner* — Thai Ba Trieu

(74) *Attorney, Agent, or Firm* — Julia Voutyras; Alleman Hall McCoy Russell & Tuttle LLP

(57) ABSTRACT

Systems and methods for using compressed intake air that is free of soot particles to clean the EGR cooler of an internal combustion engine having a turbocharger are provided herein. One example system includes an EGR valve for selectively diverting a portion of exhaust gas through an EGR conduit to an intake side of the internal combustion engine. The EGR cooler is disposed in the EGR conduit. The compressed intake air delivery system is configured to selectively divert a portion of compressed intake air compressed by the turbocharger through the EGR cooler to remove soot particles deposited in the EGR cooler.

20 Claims, 7 Drawing Sheets

USING COMPRESSED INTAKE AIR TO CLEAN ENGINE EXHAUST GAS RECIRCULATION COOLER

BACKGROUND AND SUMMARY

Exhaust gas recirculation is used to improve emission performance of diesel engines. Prior to being introduced into engine combustion chambers, the exhaust gas may be circulated through one or more EGR coolers. Due to the low temperature environment and flow characteristics of the EGR cooler, soot particles contained in the exhaust gas may be deposited onto walls of the EGR cooler to form a film of soot, often in a relatively short period of time, decreasing the heat transfer ability of the EGR cooler. As a result, the recirculated exhaust gas may not be effectively cooled and the ability of the recirculated exhaust gas to improve emission may be reduced.

Various methods have been utilized to address the issue of soot deposition in EGR coolers. In some examples, particulate filters and oxidative catalysts have been used to remove soot particles upstream of the EGR coolers. However, the particulate filters and oxidative catalysts may take up significant amount of space inside a cramped engine compartment, may require frequent maintenance and replacement.

In another example provided by U.S. Pat. No. 7,011,080 to Kennedy, a reverse airflow may be used to clean the EGR cooler. In this example, a single charge air cooler is utilized to cool the mixed charge air and recirculated exhaust gas. A flow valve that is movable between open, bypass, and reverse positions is used to control the flow of the mixed charge air and recirculated exhaust gas through the cooler. The reverse position of the flow valve provides a reverse cleaning flow through the cooling passages to remove soot particles accumulated in the cooler. However, the method provided by Kennedy may utilize contaminated exhaust air that contains soot particles for cleaning the EGR cooler, as well as increased complexity in the exhaust flow design through the EGR cooler.

To at least partially address the above issues, systems and methods for using compressed intake air that is free of soot particles to clean the EGR cooler of an internal combustion engine having a turbocharger are provided herein. One example system includes an EGR valve for selectively diverting a portion of exhaust gas through an EGR conduit to an intake side of the internal combustion engine, an EGR cooler disposed in the EGR conduit, the EGR cooler having an exhaust side and an intake side, and a compressed intake air delivery system including a compressed air conduit, the compressed intake air delivery system being configured to selectively divert a portion of compressed intake air compressed by the turbocharger through the EGR cooler to remove soot particles deposited in the EGR cooler. In some examples, a valve disposed in the compressed air conduit may control the flow of the compressed intake air. In other examples, the valve for controlling the compressed intake air flow through the compressed intake conduit may be eliminated, when the compressed air conduit may be sized and aimed in such a way that it does not interfere with flow of EGR gas into the EGR cooler, and that it is still possible to deliver the adequate amount of EGR flow for engine operation.

In this way, turbocharger pressurized intake air that is relatively free of soot particulate, and which is available from the engine turbocharger, may be used to purge through the EGR cooler to generate sufficient turbulence to dislodge soot particles deposited in the EGR cooler. In one example, the pressurized air may be used to remove cooler contaminants when EGR is not used for engine operation to reduce any disturbances to EGR flow operation.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
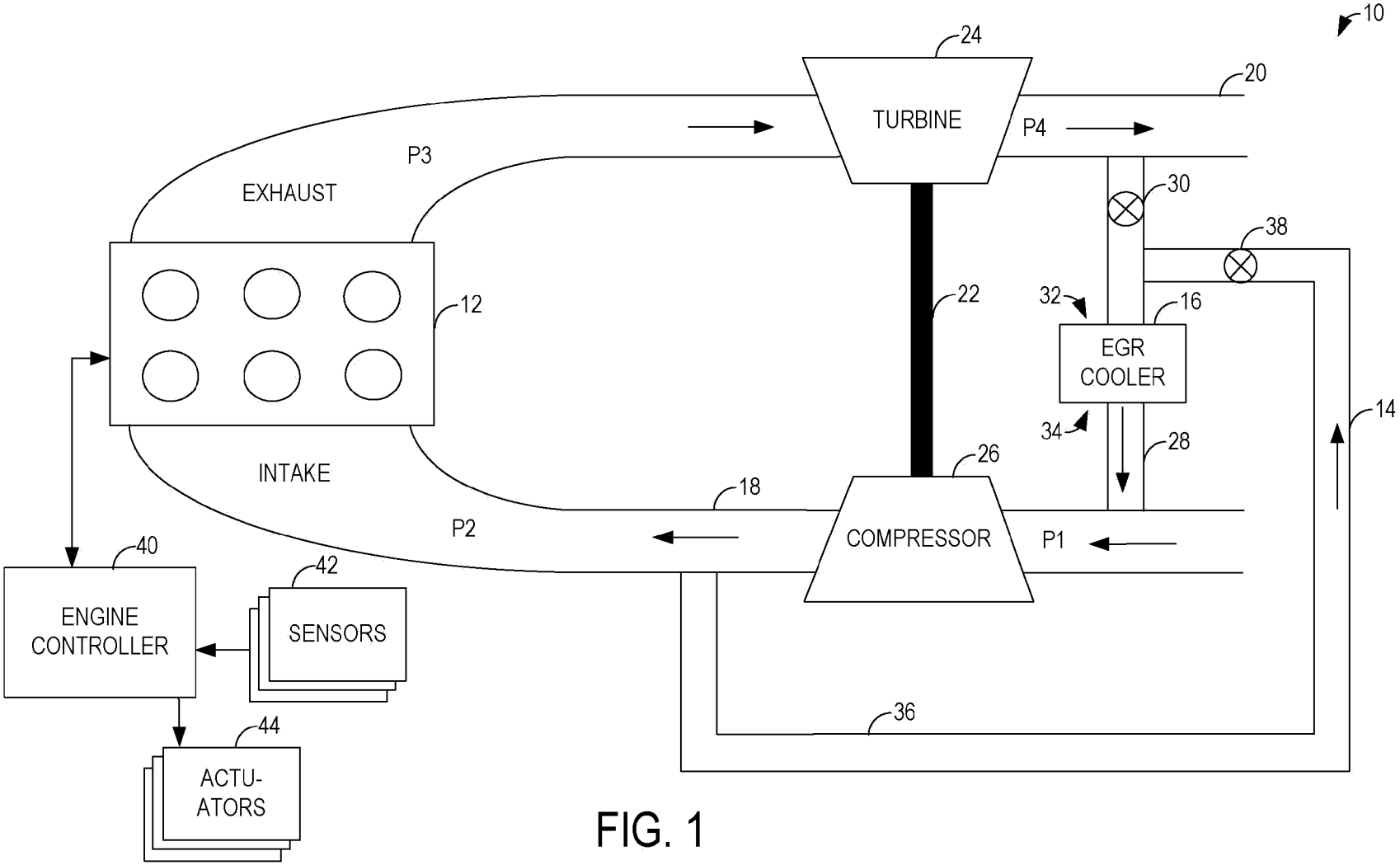
FIG. 1 is a schematic diagram illustrating a first embodiment of an EGR system that utilizes a compressed intake air delivery system to remove soot particles deposited in EGR coolers.
Figure 2:
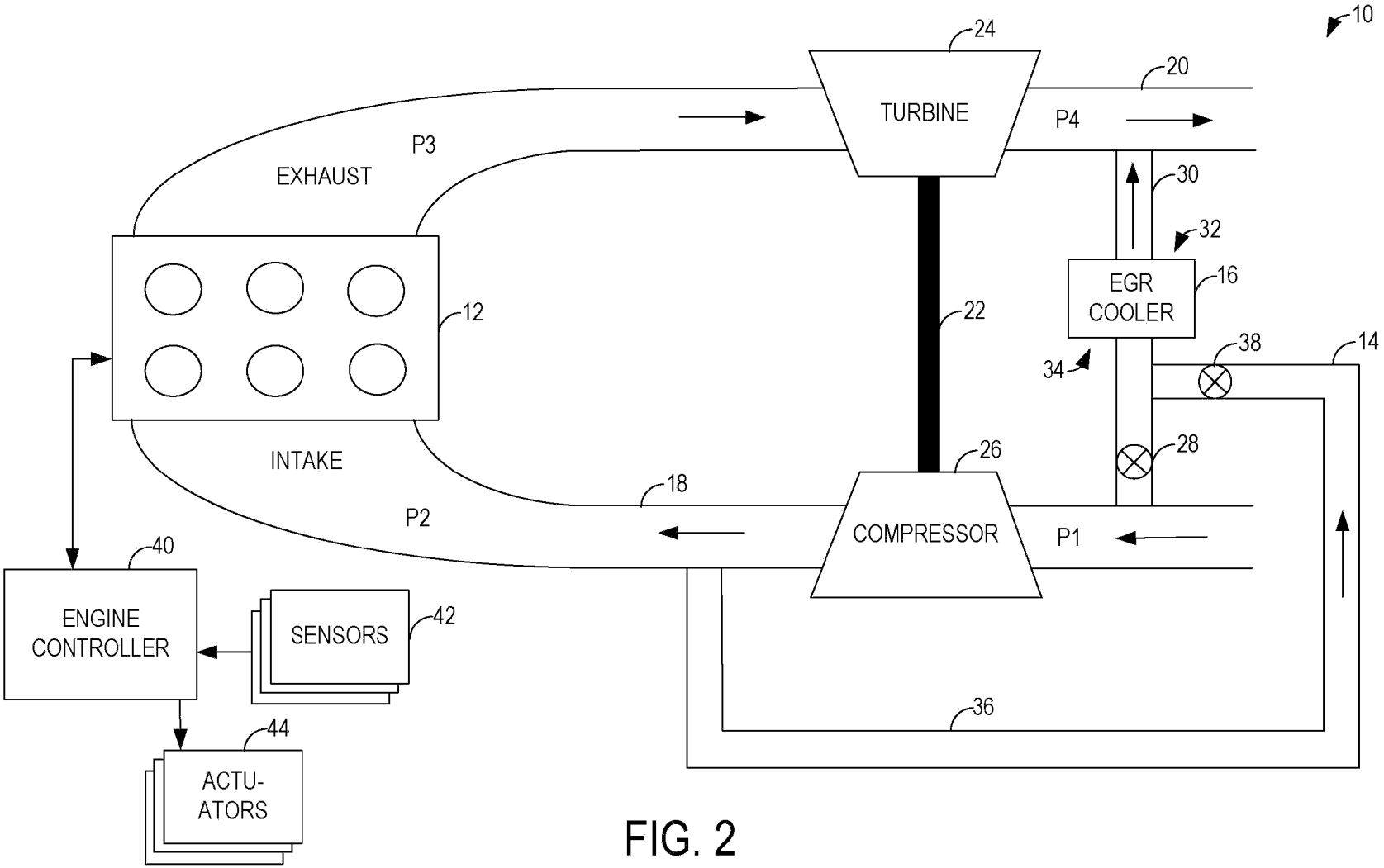
FIG. 2 is a schematic diagram illustrating a second embodiment of an EGR system that utilizes a compressed intake air delivery system to remove soot particles deposited in EGR coolers.

FIGS. 1-6 are schematic diagrams illustrating embodiments of an EGR system 10 of an internal combustion engine 12 that utilizes a compressed intake air delivery system 14 to delivery compressed air that is compressed by a turbocharger to remove soot particles deposited in an EGR cooler 16. The EGR system 10 illustrated in FIGS. 1 to 2 are low pressure EGR systems, while the EGR systems 10 illustrated in FIGS. 3 to 6 are high pressure EGR systems. For purpose of simplicity, similar parts are labeled similarly in FIGS. 1 to 6.

The internal combustion engine 12 may be coupled to an intake passage 18 and an exhaust passage 20. The engine 12 may include a turbocharger 22 having a turbine 24 and a compressor 26, where the turbine 24 may be coupled to the exhaust passage 20 and powered by exhaust gas flowing through the exhaust passage 20, and the compressor 24 may be coupled to the intake passage 18 for compressing intake air flowing through the intake passage 18. It should be appreciated that although the turbocharger in the herein illustrated embodiments includes a single turbine and a single compressor, multiple turbines and/or multiple compressors may be included.

The EGR system 10 may include an EGR conduit 28 fluidly coupled between the intake passage 18 and the exhaust passage 20 for diverting a portion of exhaust gas from the exhaust passage 20 to the intake passage 18 to be introduced back into the internal combustion engine 12 as exhaust gas recirculation (EGR). he EGR system 10 may be a low pressure EGR system 10, where the EGR conduit 28 fluidly couples the exhaust passage 20 at a location downstream of the turbine 24 to the intake passage 18 at a location upstream of the compressor 26. The EGR system may also be a high pressure EGR system 10, where the EGR conduit 28 fluidly couples the exhaust passage 20 at a location upstream of the turbine 24 to the intake passage 18 at a location downstream of the compressor 26.

The system 10 may additionally include an EGR cooler 16 disposed in the EGR conduit 28, where the EGR cooler 16 may include an exhaust side 32 proximal to the exhaust passage 20 and an intake side 34 proximal to the intake passage 18. The EGR may be circulated through the EGR cooler 16 to be cooled prior to being introduced back into the intake of the internal combustion engine.

The EGR system 10 may also include an EGR valve 30 for selectively diverting a portion of exhaust gas through an EGR conduit 28 to the intake passage 20 of the internal combustion engine 12. The EGR valve 30 may be any suitable valve for regulating air flow, such as a two way valve, one way valve, a butterfly valve, ball valve, check valve, globe valve, needle valve, piston valve, etc.

The EGR valve 30 may be a hot-side EGR valve disposed in the EGR conduit 28 on the exhaust side 32 of the EGR cooler 16 as shown in FIG. 1. The EGR valve 30 may also be a cold-side EGR valve disposed in the EGR conduit 28 on the intake side 34 of the EGR cooler 16 as shown in FIG. 2.

The EGR system 10 may further include the compressed intake air delivery system 34, which may include a compressed air conduit 36 for selectively diverting a portion of compressed intake air compressed by the compressor 26 through the EGR cooler 16 to remove the soot particles deposited in the EGR cooler 16 when the EGR is reduced or turned off. The EGR may be turned off or reduced for example when EGR is not used or is reduced for engine operation.

The EGR system 10 may also include a turbocharger-to-EGR valve 38 for controlling flow of the compressed intake air through the compressed air conduit 36. The turbocharger-to-EGR valve 38 may be any suitable valve for regulating air flow, such as a two way valve, one way valve, a butterfly valve, ball valve, check valve, globe valve, needle valve, piston valve, etc. The turbocharger-to-EGR valve 38 may be a hot-side valve disposed on the exhaust side 32 of the EGR cooler 16 as shown in FIGS. 1, or a cold-side valve disposed in the compressed air conduit 36 on the intake side 34 of the EGR cooler 16 as shown in FIG. 2.

Figure 5:
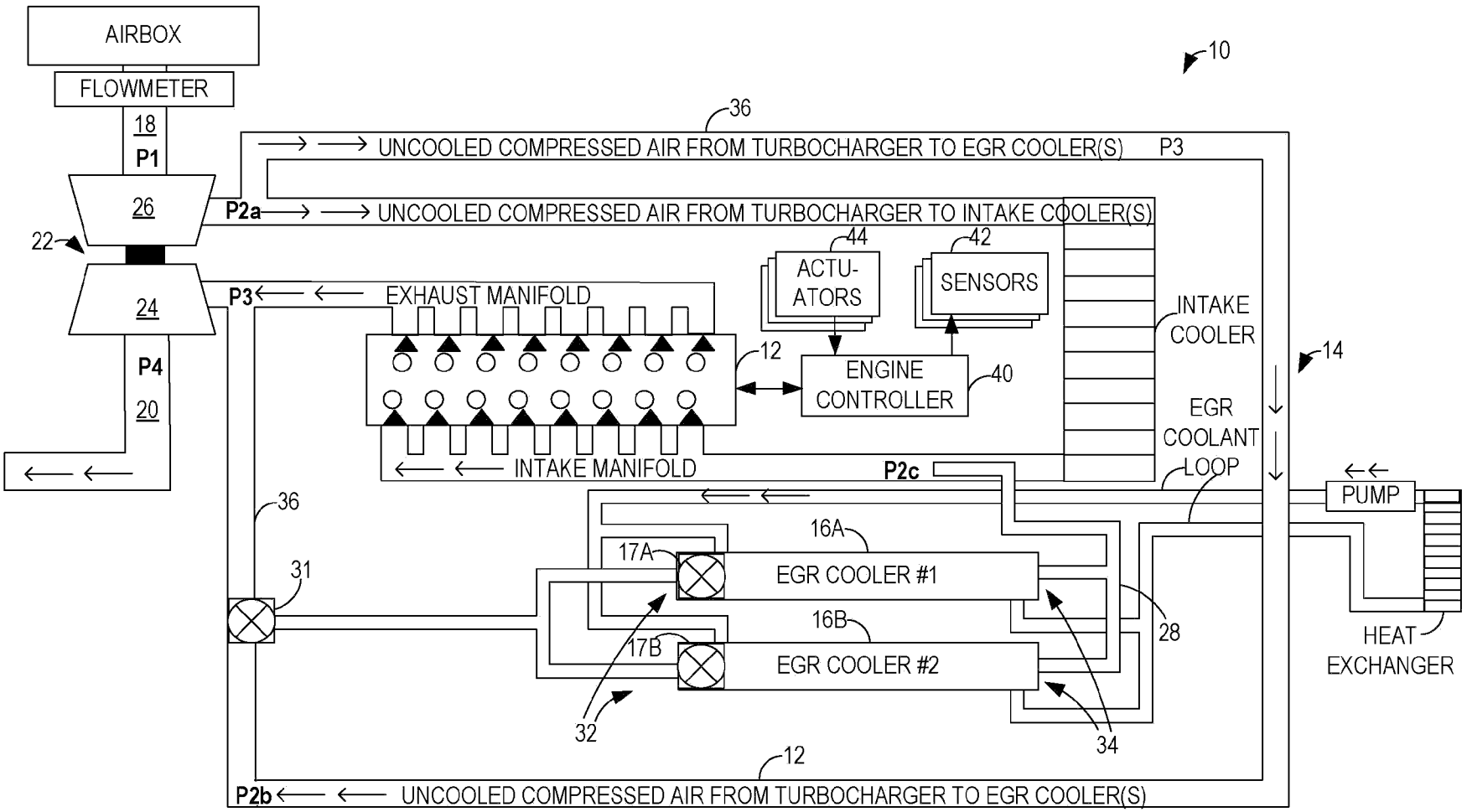
FIG. 5 is a schematic diagram illustrating a fifth embodiment of an EGR system that utilizes a compressed intake air delivery system to remove soot particles deposited in EGR coolers.
Figure 6:
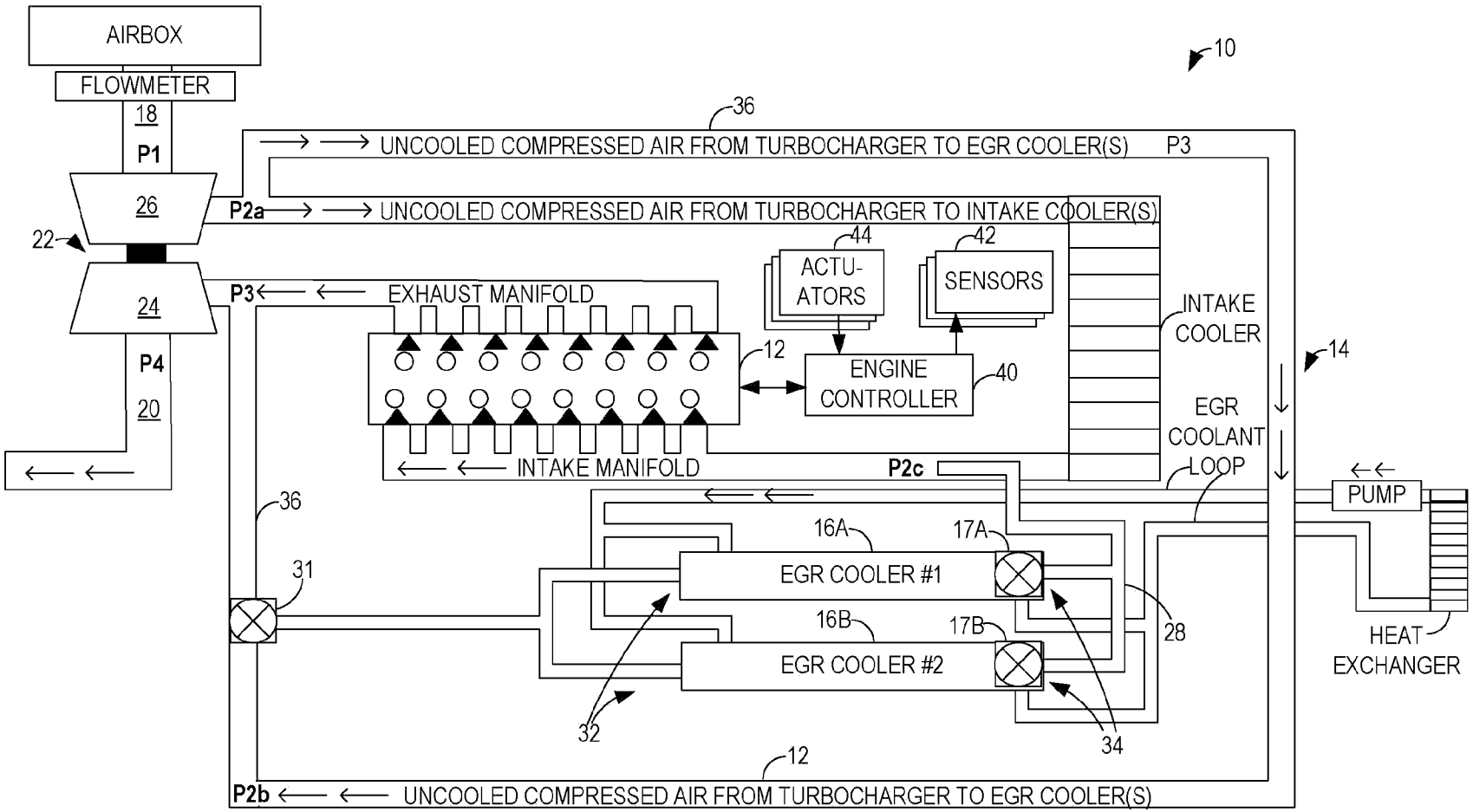
FIG. 6 is a schematic diagram illustrating a sixth embodiment of an EGR system that utilizes a compressed intake air delivery system to remove soot particles deposited in EGR coolers.

It should also be appreciated that in some examples, a combination valve may be used. For example, the EGR valve 30 and the turbocharger-to-EGR valve 38 may be combined into a single valve, such as a single dual position valve 31 as illustrated in FIGS. 5 and 6, for controlling both the EGR flow and the compressed air flow through the EGR cooler 16.

The system 10 may take advantage of pressure differences at different locations in the intake passage 18 and/or the exhaust passage 20 in order to purge the compressed intake air through the EGR cooler 16 to dislodge soot particles deposited in the EGR cooler 16.

In the example shown in FIG. 1, a pressure differential may exist, at least under certain engine operating conditions, between the intake passage 18 at a location downstream of the compressor 26 (P2) and the intake passage 18 at a location upstream of the compressor (P1). This pressure differential (P2−P1) may cause the compressed intake air to flow through the compressed air conduit 36 and enter the EGR cooler 16 from the exhaust side 32 and exits the EGR cooler 16 from the intake side 34.

In another example shown in FIG. 2, a pressure differential may exist, at least under certain engine operating conditions, between the intake passage 18 at a location downstream of the compressor 26 (P2) and the exhaust passage 20 at a location upstream of the turbine 24 (P4). This pressure differential (P2−P4) may cause the compressed intake air to flow through the compressed air conduit 36 and enter the EGR cooler 16 from the intake side 34 and exit the EGR cooler 16 from the exhaust side 32.

In the examples shown in FIG. 3 to 6, a pressure differential may exist, at least under certain engine operating conditions, between the intake passage 18 at a location downstream of the compressor 26 (P2*b*) and another location also downstream of the compressor (P2*c*). This pressure differential (P2*b*−P2*c*) may cause the compressed intake air to flow through the compressed air conduit 36 and enter the EGR cooler 16 from the exhaust side 32 and exit the EGR cooler 16 from the intake side 34.

In some examples, the system 10 may also adjust one or more engine operating conditions to generate a sufficient differential pressure in order to purge the compressed intake air through the EGR cooler 16.

In some examples, such as illustrated in FIG. 2, the dislodged soot particulates may be disposed in the exhaust passage 20. The soot particulates disposed in the exhaust passage may be removed by a downstream emission control device, such as a catalyst and a particulate filter. In the examples illustrated in FIGS. 1, 3 to 6, the dislodged soot particulates may be disposed in the intake passage 18 and combusted by the engine 12.

In some examples, the system 10 may adjust the operation of one or more valves to control the velocity and turbulence of the flow of the compressed intake air through the compressed air conduit and/or the EGR cooler 16. For example, the system 10 may adjust the operation of the turbocharger-to-EGR valves 38, and/or individual EGR cooler valves 17 (as shown in FIGS. 3 to 6). The compressed intake air being purged through the EGR cooler 16 may have a sufficiently high velocity that it generates a sufficiently high Reynolds number inside the EGR coolers to enable the compressed intake air to dislodge soot particles deposited in the EGR cooler 16.

The system 10 may further include an engine controller 40 coupled to various sensors 42 for sensing various engine operating conditions. The various sensors 42 may for example include various temperature sensors, such as temperature sensors for sensing temperatures of the before-cooled EGR, the after-cooled EGR, and the intake. The various sensors may include various flow rate sensors, such as flow rate sensors for sensing a flow rate of the EGR and the compressed intake air.

The engine controller 40 may be configured to determine various engine operating conditions, based on for example various sensor readings provided by the various sensors 42. For example, the cooling efficiency of an EGR cooler may be determined from an after-cooled temperature of EGR after being cooled by the EGR cooler, or estimated from various engine operating conditions, such as a length and conditions of engine combustion. The flow rate of EGR through an EGR cooler may be measured by one or more flow meters located at or near the EGR cooler. The intake temperature and the after-cooled temperature of the exhaust gas may be determined using one or more temperature sensors positioned at various locations of the intake, exhaust, and/or EGR pathways.

The engine controller 40 may be coupled to various actuators for controlling the operations of the various actuators, in some instances in response to various engine operations. In particular, the engine controller 40 may be coupled to and control the operation of the EGR valve 30 and the turbocharger-to-EGR valve 38 in responses to engine operating conditions. For example, the engine controller 40 may be configured to selectively divert a portion of the compressed intake air using the compressed air delivery system through an EGR cooler to remove soot particles deposited in the EGR coolers under one or more of the following engine operating conditions indicating that the EGR coolers are not operating efficiently in cooling the EGR due to soot particulate deposition that are detected by the engine controller: a cooling efficiency of the EGR cooler is below a threshold value, a flow rate of EGR through the EGR cooler is below a threshold value, an intake temperature is above a threshold value, and an after-cooled temperature of the exhaust gas after cooled by the EGR cooler is above a threshold value.

The engine controller 40 may determine, for example from one or more engine operating conditions, that the EGR cooler 16 is not operating efficiently in cooling the EGR due to soot particulate accumulation in the EGR cooler 16. The engine controller 40 may subsequently stop the EGR flow through the EGR cooler 16, for example by turning off the EGR valve 30 in the examples shown in FIGS. 1-4 or by adjusting the dual position valve 31 in the examples shown in FIGS. 5-6. The engine controller 40 may also open the flow of the compressed intake air through the compressed air conduit 36, for example by turning on the turbocharger-to-EGR valve 38 in the examples shown in FIG. 1-4 or by adjusting the dual position valve 31 in the examples shown in FIGS. 5-6.

It should be appreciated, in some examples, the various valves, such as the turbocharger-to-EGR valve 38 for controlling the compressed intake air flow through the compressed intake conduit 36, and/or the individual EGR cooler valves 17 (as shown in FIGS. 3-6) for controlling the flow through the individual EGR coolers 16, may be eliminated, for example when the compressed air conduit 36 may be sized and aimed in such a way that it does not interfere with flow of EGR gas into the EGR cooler 16, and that it is still possible to deliver the adequate amount of EGR flow for engine operation.

It should be appreciated, although in this example, the EGR system 10 includes a single EGR cooler and the EGR system utilizes compressed intake air delivery system 14 to remove soot particles deposited in the EGR cooler, in other examples, the EGR system may include multiple EGR coolers, and the compressed intake air delivery system may include mechanisms (e.g., conduits & valves) for delivering compressed intake air compressed by turbocharger to remove soot particles deposited in the multiple EGR coolers.

It should also be appreciated that the EGR valve 30 may include multiple valves work in coordination to control the flow of the EGR, the turbocharger-to-EGR valve 38 may include multiple valves work in coordination to control the flow of the compressed air through the compressed air conduit 36. It should be further appreciated that multiple conduits may be included in the compressed air conduit 36 for delivering the compressed air to the EGR cooler 16.

Figure 3:
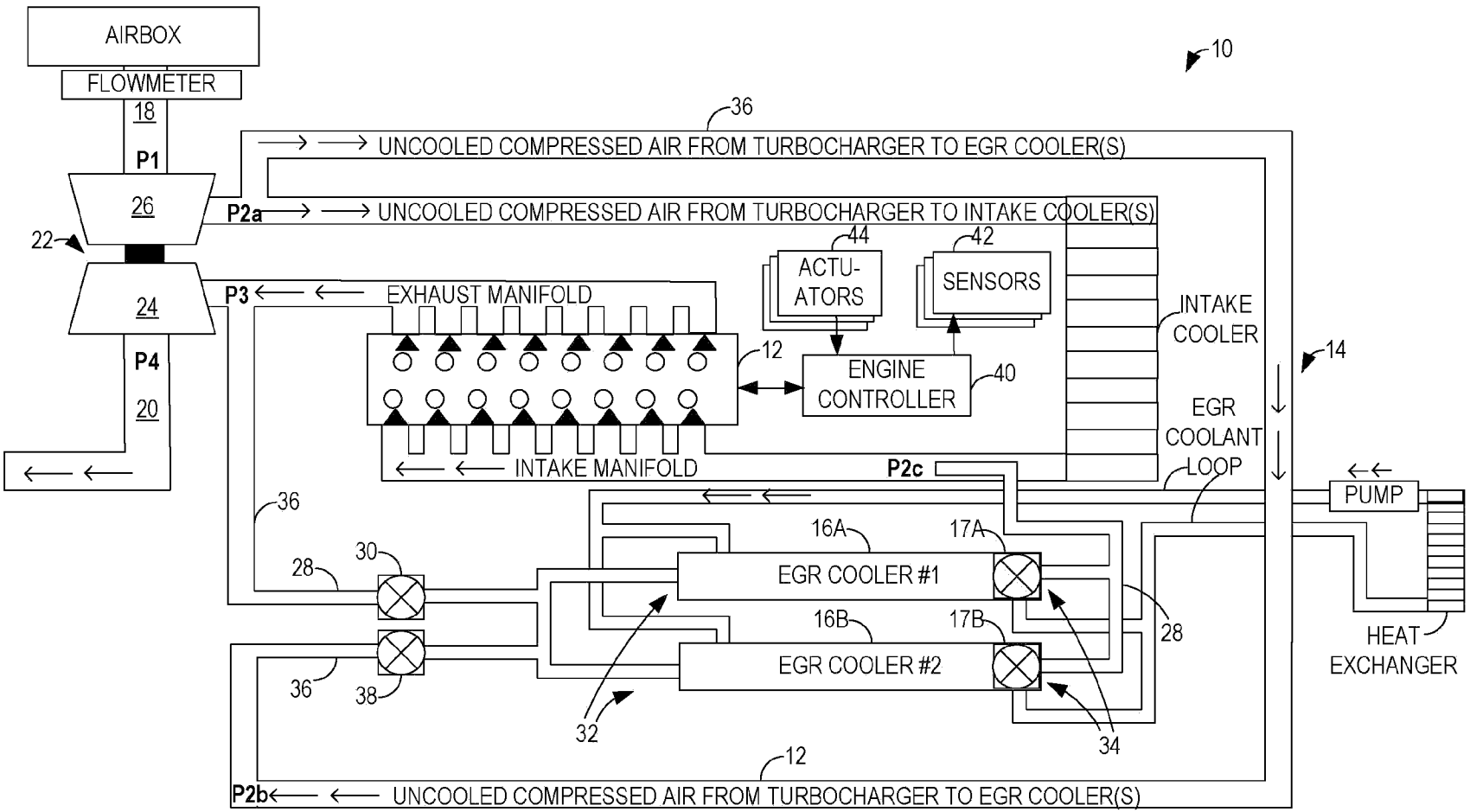
FIG. 3 is a schematic diagram illustrating a third embodiment of an EGR system that utilizes a compressed intake air delivery system to remove soot particles deposited in EGR coolers.
Figure 4:
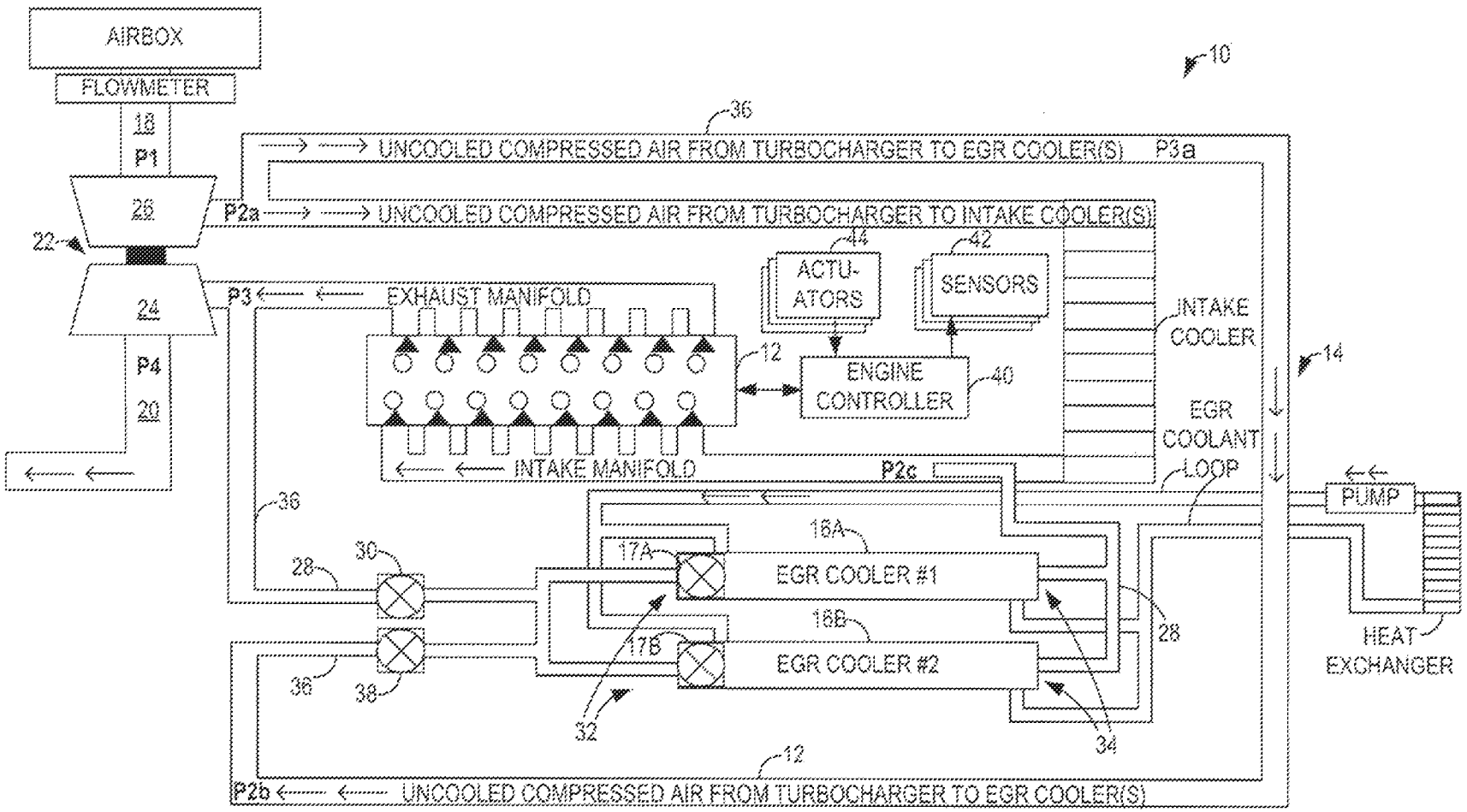
FIG. 4 is a schematic diagram illustrating a fourth embodiment of an EGR system that utilizes a compressed intake air delivery system to remove soot particles deposited in EGR coolers, where the EGR system is a high pressure EGR system.

In examples as illustrated in FIGS. 3 & 4, the EGR system 10 includes two EGR coolers 16, a first EGR cooler 16A and a second EGR cooler 16B. Individual EGR cooler valves 17 (17A & 17B) are provided to control air flow through the individual EGR coolers. The individual EGR cooler valves 17 may operate in coordination to control the air flow through the individual EGR coolers.

The individual EGR cooler valves 17 may be hot side valves positioned on the hot side of the EGR coolers, or cold side valves positioned on the cold side of the EGR coolers. The example as illustrated in FIG. 3 shows the individual EGR cooler valves 17 as cold side valves while the example as illustrated in FIG. 4 shows the individual EGR cooler valves 17 as hot side valves.

As will be appreciated by one of ordinary skill in the art, the specific routines described below in the flowcharts may represent one or more of any number of processing strategies such as event-driven, interrupt-driven, multi-tasking, multi-threading, and the like. As such, various steps or functions illustrated may be performed in the sequence illustrated, in parallel, or in some cases omitted. Likewise, the order of processing is not necessarily required to achieve the features and advantages of the example embodiments of the invention described herein, but is provided for ease of illustration and description. Although not explicitly illustrated, one of ordinary skill in the art will recognize that one or more of the illustrated steps or functions may be repeatedly performed depending on the particular strategy being used. Further, these figures graphically represent code to be programmed into the computer readable storage medium in engine controller 40.

Figure 7:
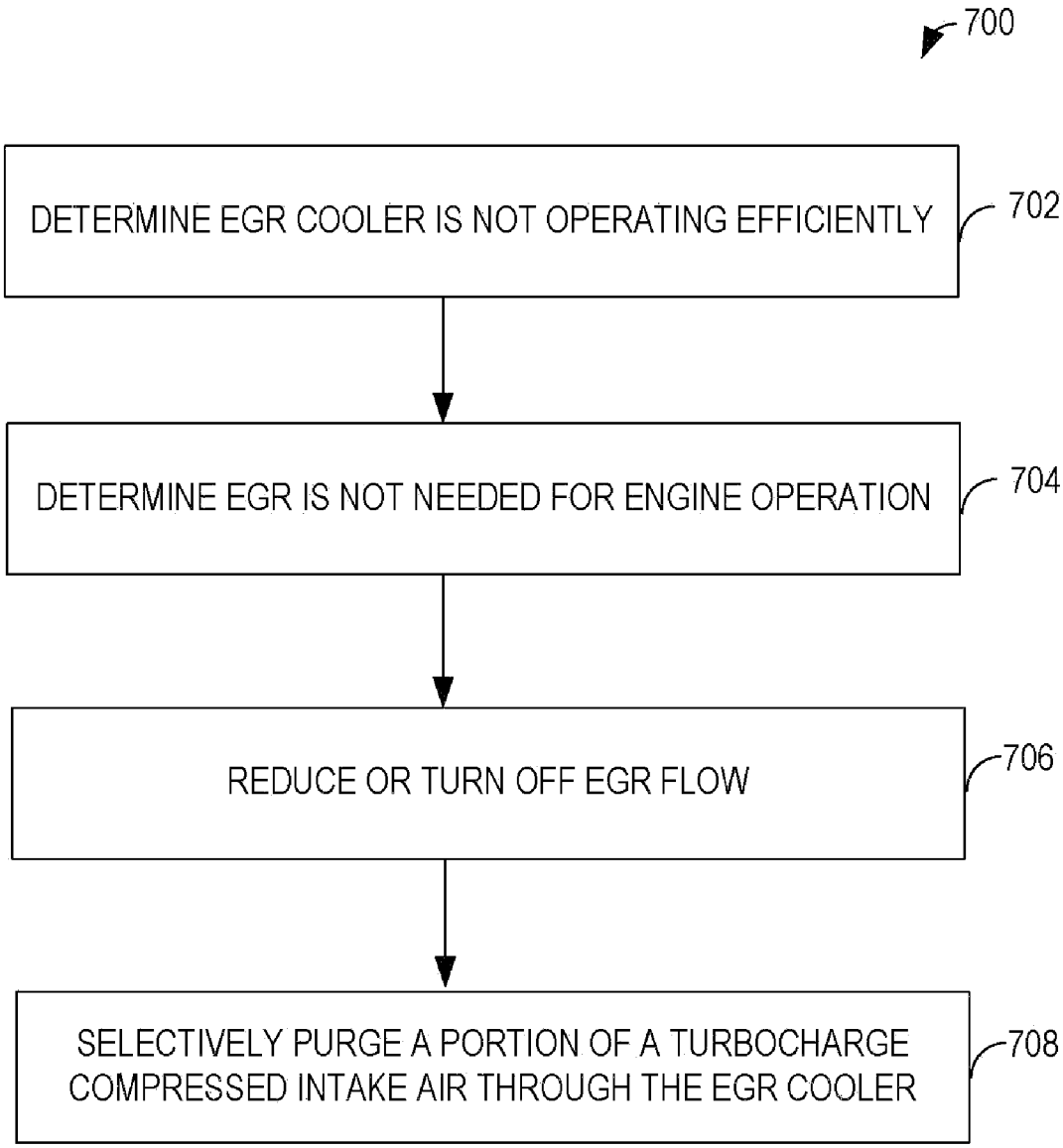
FIG. 7 is a flow chart of an example method for utilizing compressed intake air compressed by a turbocharger of the internal combustion engine to remove soot particles deposited in EGR coolers.

FIG. 7 is a flowchart of a routine 700 for removing soot deposit from an exhaust gas recirculation (EGR) cooler for cooling exhaust gas recirculation (EGR) of an internal combustion engine. The routine 700 may be implemented in the EGR system 10 of FIGS. 1 to 6.

The routine may include at 702 determining that the EGR cooler is not operating efficiently. The determination may be based on that a cooling efficiency of the EGR cooler is below a threshold value, a flow rate of EGR through the EGR cooler is below a threshold value, an intake temperature is above a threshold value, and an after-cooled temperature of the exhaust gas after cooled by the EGR cooler is above a threshold value.

The routine may include at 704 determining an engine operating conditions under which EGR is not needed for engine operation. Such engine operating conditions are discussed in detail in reference to FIGS. 1 to 6.

The routine may further include at 706 reducing or turning off EGR flow, for example by controlling operation of an EGR valve disposed in an EGR conduit. Such operations are also discussed in detail in reference to FIGS. 1 to 6.

The routine may further include at 708 selectively diverting or purging a portion of a turbocharger compressed intake air through the EGR cooler, for example by controlling operation of a valve (e.g., turbocharger-to-EGR valve 38) disposed in a compressed intake air conduit, and/or by adjusting one or engine operating conditions to generate the necessary pressure differential for purging the compressed intake air through the EGR cooler. The purge may last for a predetermined period of time or may be controlled by an engine controller based on one or more engine operating conditions, such as a flow rate of the compressed intake air through the EGR cooler. Such operations are discussed in detail in reference to FIGS. 1 to 6.

In some examples, the purged compressed air enters the EGR cooler from an exhaust side of the EGR cooler proximal to an exhaust passage of the internal combustion engine and exits from the intake side of the EGR cooler proximal to an intake passage of the internal combustion engine. In other examples, the purged compressed air enters the EGR cooler from the intake side of the EGR cooler proximal to an intake passage of the internal combustion engine and exits from an exhaust side of the EGR cooler proximal to an exhaust passage of the internal combustion engine. The after-purged compressed air containing soot particulates may be disposed in the intake to be burned off by the engine, or may be disposed in the exhaust to be treated by a downstream emission control device, such as a particulate filter.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, V-4, diesel, gasoline, alternative fuel, and other engine types. The subject matter of the present disclosure includes all novel and nonobvious combinations and subcombinations of the various systems and configurations, and other features, functions, and/or properties disclosed herein.

The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for removing soot deposit from a pair of exhaust gas recirculation (EGR) coolers for cooling exhaust gas recirculation (EGR) of an engine, comprising:

selectively diverting a portion of un-cooled turbocharger compressed intake air through the EGR coolers, in parallel, when the EGR is reduced to remove contaminants from the EGR coolers; and cooling the EGR coolers via coolant delivered in parallel to the EGR coolers from a coolant pump.

2. The method of claim 1, wherein the diverting occurs when the EGR is turned off.

3. The method of claim 1, wherein the diverting occurs when the EGR is reduced.

4. The method of claim 1, wherein a flow rate of purged compressed air is controlled by a valve, and wherein low pressure EGR is selectively directed through the EGR coolers based on engine operating conditions.

5. The method of claim 4, wherein the purged compressed air enters the EGR coolers from an exhaust side and exits from an intake side of the EGR coolers.

6. The method of claim 1, wherein purged compressed air enters the EGR cooler from an intake side of the EGR coolers and exits from an exhaust side of the EGR coolers.

7. The method of claim 1, wherein purging occurs when a cooling efficiency of the EGR coolers is below a threshold value.

8. The method of claim 1, wherein purging occurs when an intake temperature is above a threshold value.

9. An EGR system of an internal combustion engine having a turbocharger that includes a turbine and a compressor, the system comprising:

an EGR valve for selectively diverting a portion of exhaust gas through an EGR conduit to an intake side of the internal combustion engine;

a pair of EGR coolers disposed in the EGR conduit in parallel, the EGR coolers having an exhaust side and an intake side;

a compressed intake air delivery system including a compressed air conduit, the compressed intake air delivery system being configured to selectively divert a portion of compressed intake air compressed by the turbocharger through the EGR coolers to remove soot particles deposited in the EGR coolers; and a coolant system including a pump directing coolant, in parallel, to each of the EGR coolers, and then to a heat exchanger, and then back to the pump.

10. The system of claim 9, wherein the compressed intake air delivery system is configured to selectively divert the compressed intake air through the EGR coolers when exhaust gas recirculation is reduced, each EGR cooler including an exhaust side valve adjacent its respective EGR cooler.

11. The system of claim 9, wherein the compressed intake air delivery system is configured to selectively divert the compressed intake air through the EGR coolers when exhaust gas recirculation is turned off.

12. The system of claim 9, wherein the EGR system is a low pressure EGR system, wherein the exhaust gas for EGR is diverted from an exhaust passage downstream of the turbine to an intake passage upstream of the compressor.

13. The system of claim 9, wherein the EGR system is a high pressure EGR system, wherein the exhaust gas for EGR is diverted from an exhaust passage upstream of the turbine to an intake passage downstream of the compressor.

14. The system of claim 9, further comprising a valve for controlling flow of the compressed intake air through the EGR coolers.

15. The system of claim 9, further including a controller configured to adjust one or more engine operating conditions to create a sufficient pressure differential to purge the compressed intake air through the EGR coolers.

16. The system of claim 9, wherein the compressed intake air enters the EGR coolers from the intake side and exits from the exhaust side.

17. The system of claim 9, wherein the compressed intake air enters the EGR coolers from the exhaust side and exits from the intake side.

18. The system of claim 9, wherein the EGR system is configured to divert the compressed intake air through the EGR coolers when a cooling efficiency of the EGR coolers is below a threshold value.

19. The system of claim 9, wherein the EGR system is configured to divert the compressed intake air through the EGR coolers when any one or a combination of the following occurs: a flow rate of the EGR coolers is below a threshold value, an intake temperature is above a threshold value, and an after-cooled temperature of exhaust gas cooled by the EGR coolers is above a threshold value.

20. An EGR system of an internal combustion engine having a turbocharger that includes a turbine and a compressor, comprising:

a high pressure EGR conduit fluidly coupling an exhaust passage at a location upstream of the turbine, to an intake passage at a location downstream of the compressor;

a pair of EGR coolers disposed in the EGR conduit, the EGR coolers having an exhaust side and an intake side, the EGR coolers being positioned in parallel;

an EGR valve for selectively diverting a portion of exhaust gas through the EGR conduit to the intake passage, where the EGR valve is a hot-side EGR valve disposed at the exhaust side of the EGR coolers;

a compressed air conduit fluidly coupling the intake passage at a location between the compressor and the internal combustion engine, to the EGR coolers at the exhaust side;

a coolant system including a pump directing coolant, in parallel, to each of the EGR coolers, and then to a heat exchanger, and then back to the pump; and a compressed air valve for controlling a flow of compressed air through the compressed air conduit, where the compressed air valve is configured to divert a portion of the compressed air through the compressed air conduit when at least one of the following engine operating conditions occurs: a cooling efficiency of the EGR coolers is below a threshold value, a flow rate of the EGR coolers is below a threshold value, an intake temperature is above a threshold value, and an after cooled temperature of the exhaust gas after being cooled by the EGR coolers is above a threshold value.

* * * * *